US006969691B2

(12) United States Patent
Takeuchi et al.

(10) Patent No.: US 6,969,691 B2
(45) Date of Patent: Nov. 29, 2005

(54) DOCTOR BLADE FOR REMOVING WATER

(75) Inventors: Tetsuo Takeuchi, Tokyo (JP); Hirofumi Ishii, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 203 days.

(21) Appl. No.: 10/385,552

(22) Filed: Mar. 11, 2003

(65) Prior Publication Data

US 2003/0181117 A1 Sep. 25, 2003

(30) Foreign Application Priority Data

Mar. 25, 2002 (JP) ..... 2002-083776

(51) Int. Cl.[7] ..... D03D 13/00; B32B 27/02

(52) U.S. Cl. ..... 442/218; 442/203; 442/220; 442/239; 442/268; 442/270; 442/271; 442/275; 442/103; 442/149; 442/150; 428/81; 428/82; 428/88; 428/96; 428/85; 428/192; 428/193; 428/194; 15/256.5; 15/256.51; 401/5; 427/428.14; 427/356; 427/357; 427/358

(58) Field of Search ..... 442/203, 218, 442/220, 239, 268, 270, 271, 275, 103, 149, 442/150; 15/256.5, 256.51; 428/81, 82, 88, 428/96, 85, 192, 193, 194; 401/5

(56) References Cited

U.S. PATENT DOCUMENTS 2,767,529 A * 10/1956 Baliol ..... 451/49
4,549,933 A * 10/1985 Judd et al. ..... 162/281
6,643,890 B2 * 11/2003 Carrier ..... 15/256.51

FOREIGN PATENT DOCUMENTS

DE 944413 C * 6/1956
JP 56-20697 2/1981

OTHER PUBLICATIONS

European Search Report for EP03005726.9.*

* cited by examiner

*Primary Examiner*—Norca L. Torres-Velazquez
(74) *Attorney, Agent, or Firm*—Howson and Howson

(57) ABSTRACT

A doctor blade for removing water from a mating member, such as a grooved elastic belt in the press part of a paper-making machine, comprises a resin-impregnated fibrous laminate, in which at least a part of the warp of a base material in the laminate, which comes into contact with the mating member, is brush-shaped, so that the warp enters the insides of the grooves to remove water therefrom.

4 Claims, 11 Drawing Sheets

FIG.10

| Structural part | Item | | Comparative example -1 | Comparative example -2 | Example -1 | Example -2 | Example -3 | Example -4 | Example -5 |
|---|---|---|---|---|---|---|---|---|---|
| Felt part | Base material | MD yarn (Product) | PET spun yarn (Yarn count 10) | PET spun yarn (Yarn count 5) | PET mono-filament 550 dtex | PET mono-filament 110 dtex | PET multi-filament (4.4dtex 250F) | Nylon 6 mono-filament 550 dtex | Nylon 6 multi-filament 360 dtex × 3 |
| | | CMD yarn (Product) | PET spun yarn (Yarn count 10) | ← | ← | ← | ← | ← | ← |
| | | Basis weight (g/m$^2$) | 100 | 130 | 100 | 140 | 140 | 100 | 130 |
| | Batt material PET | | 17dtex | ← | ← | ← | ← | ← | ← |
| | Density | | 0.35 | ← | ← | ← | ← | ← | ← |
| Resin part | Material | | Polyurethane + epoxy resin | ← | ← | ← | ← | ← | ← |
| | Resin impregnation rate(R/F)% | | 20 | ← | ← | ← | ← | ← | ← |
| | Thickness T(mm) | | 10 | ← | ← | ← | ← | ← | ← |
| Water removing capability | Compared by ratio | | 100 | 93 | 122 | 128 | 110 | 130 | 116 |

Resin impregnation rate(R/F)% : Weight ratio of resin to fiber (a)

(b)

DOCTOR BLADE FOR REMOVING WATER

CROSS REFERENCE TO RELATED APPLICATIONS none

FIELD OF THE INVENTION

This invention relates to a doctor blade for removing water, and especially a doctor blade suitable for removing water from an elastic belt in the press part of a papermaking machine.

BACKGROUND OF THE INVENTION

FIG. 12 shows a shoe press apparatus in the press part of a papermaking machine. In this shoe press apparatus, a pair of felts F, and an endless, air-impermeable, elastic belt B, are pinched in a nip N comprising a press roll P and shoe S. When the press roll P rotates in the direction of arrow P', the elastic belt B also rotates in the direction of arrow B'. A wet paper web W passing through the nip N is pinched between the pair of felts F, and water is squeezed from the web. Oil is supplied to the inside of the elastic belt B to reduce friction against the shoe S.

Since the surface of the shoe S used in this shoe press apparatus conforms to the outer surface of the press roll P, the area of the nip is large compared with that of a press apparatus comprising a pair of press rolls (not shown), and a greater water squeezing effect can be achieved. Therefore, this shoe press apparatus has the advantage that less fuel is required for drying the wet paper web W after water is squeezed from it.

FIG. 13 is an enlarged cross-sectional view showing the structure of an elastic belt B used in the above-mentioned shoe press apparatus. As shown in FIG. 13, the elastic belt B comprises a base member b, and high molecular weight elastic members e, provided on both sides of the base member b. The base member b imparts strength to the elastic belt B as a whole. A woven fabric having a warp and weft is used for the base member. The high molecular weight members e are composed of a resin, such as a urethane resin, having a Shore hardness A of 70 to 98 degrees. Both the felt-contacting surface and the shoe-contacting surface of the elastic belt are composed of such resins. The water squeezed from a wet paper web W in the nip N of a shoe press apparatus may be held in a plurality of grooves provided on the felt-contacting surface of an elastic belt B.

When the elastic belt B having the above-described structure is provided in a shoe press apparatus, compressed air is supplied to the inside of the belt to expand the belt into a cylindrical shape.

At the nip N of the shoe press apparatus, part of the water squeezed from a wet paper web W moves to the elastic belt B through the felts F, which pinch the wet paper web. While most of the water which moves to the elastic belt B is shaken off in the direction of the arrow a of FIG. 12 as a result of the movement of the belt, part of the water sometimes continues to adhere to the belt and re-enters the press part. Thus, water adhering to the elastic belt B may not be removed adequately from the wet paper web W.

It is conceivable that a doctor blade, of the kind used to removes water adhering to the roll, may be used to remove water from the an elastic belt B. Metallic doctor blades, and doctor blades wherein a felt is impregnated with a wear-resistant synthetic material comprising rubber or resin, have been used to remove water from rolls, as disclosed in Unexamined Japanese Patent Publication No. 20697/1981. However such doctor blades to not exhibit good water removal capabilities when used with an elastic belt.

Although a metallic doctor blade can remove water from an elastic belt B, it has a problem in that it causes the elastic belt B to wear out rapidly. Moreover, when an elastic belt B is expanded by compressed air supplied to the inside of the belt, its exterior surface tends to become bowed, and is not necessarily straight in the cross machine direction. Therefore it is difficult to achieve uniform contact between a metallic doctor blade and the elastic belt. There is also a risk of damaging the elastic belt by digging the tip of the metallic doctor blade into the elastic belt.

On the other hand, a doctor blade comprising a felt impregnated with a wear-resistant synthetic resin exhibits excellent adhesion to the surface of an elastic belt, and may be capable of removing water from the surface the belt. However, when this doctor blade is used with an elastic belt having grooves, water may not be removed from the grooves adequately, since the fibers of the doctor blade may not enter the grooves.

SUMMARY OF THE INVENTION

The doctor blade according to the invention comprises a fibrous laminate impregnated with resin, said fibrous laminate comprising a base material having warp, wherein at least a part of the warp of the base material which is adapted to contact a mating member is brush-shaped.

Where the fibrous laminate comprises first and second layers, and the brush-shaped part of the warp of the base material constitutes at least a part of the first layer, the resin impregnation rate of the first layer is preferably less than the resin impregnation rate of the second layer.

Preferably, the part of the warp of the base material which is adapted to contact a mating member is a monofilament of 110 dtex or more, or multifilament of 400 dtex or more.

A doctor blade having the above structure exhibits improved water removal capability since at least a part of warp (i.e., the yarns in parallel with the direction of travel of a mating member) is brush-shaped and enters the insides of the grooves and removes the water therefrom.

BRIEF DESCRIPTION OF DRAWINGS

FIG. 1(*b*) and FIG. 1(*c*) are cross-sectional views which show different shapes of doctor blades in accordance with the invention.

FIGS. 1(*d*)–1(*g*) are perspective views showing examples of doctor blades wherein the warp is brush-shaped;

FIG. 1(*h*)) is a side view of the doctor blade of FIG. 1(*g*);

FIG. 2(*b*) is an plan view showing a fibrous laminate in which the fibers are oriented in two directions;

FIG. 3(*b*) is a schematic view showing a doctor blade in a shoe press, where the doctor blade is in a deformed condition and in pressing contact with an elastic belt;

FIG. 10 is a table showing the results of water removal capability tests conducted on five doctor blades according to different examples of the invention, and three comparative examples;

FIG. 11(*b*) is an explanatory cross-sectional view illustrating the extent to which the brush-shaped fibers of doctor blades in accordance with the invention enter the grooves of a belt;

DETAILED DESCRIPTION OF THE PREFERRED EMBODIMENTS

A doctor blade for removing water according to the invention is made by impregnating a fibrous laminate 50 with resin. The laminate 50 is made by laminating and integrating a plurality of base materials 20 and a plurality of fibrous layers 30.

The term "warp" as used herein refers to the threads which extend generally parallel to the direction of movement of the mating member. Although a woven fabric or yarn layer composed of a general-purpose fiber may be used as the base material 20, a monofilament having decitex value of 110 dtex or more, or a multifilament yarn of 400 dtex or more, is preferably used for at least the part of the warp which comes into contact with a mating member. A part of the warp that comes into contact with the mating member (the elastic belt) is made brush-shaped either before use, or during use due to the wear of the fibrous layers. The warp enters the grooves of the belt and removes the water in the grooves thereby improving the water removal capability of the doctor blade. The brush-shaped warp protrudes from a doctor blade as shown in FIGS. 1(*d*)–1(*h*). In FIGS. 1(*d*)–1(*f*), an end surface of the doctor blade in the longitudinal direction, including the corners, is used for removing water. In the case of FIGS. 1(*g*) and 1(*h*), one of the faces of the doctor blade engages a mating member to remove water. In these cases, it is desirable to use multifilament yarn of 400 dtex or more, composed of single yarns of 4 dtex or more for improved water removal capability. In addition, when separated fibers are used for the warp, the warp is separated during use, and large numbers of fibers enter the grooves of the elastic belt for improved a water removal capability.

One method of making the warp brush-shaped before use, is to form a laminate of needled fibrous layers in such a way that the fibrous layers are not laminated in a part of the base material. The weft is then removed from the part of the base material where the fibrous layers are not laminated, and the warp is cut evenly and to form a brush shape. Another method of making the warp brush-shaped before use is to use a different material for the part other than the warp, and to immerse the laminate in a solvent where the part other than the warp is dissolved, leaving a brush-shaped warp.

Alternatively, materials which wear out easily as compared with the warp can be used to make the warp brush-shaped during use. The fibers other than the warp at the surface which is in contact with the mating member wear out in use. As a result, the warp protrudes in the shape of a brush.

When a woven fabric is used for the base material 20, it is desirable to form the weft from a multifilament or woolen yarn composed of thin threads since there is a possibility that the weft will fall off due to abrasion and get into the press part. Alternatively, a water-soluble fiber, which dissolves in water during use. Fibers which are separated chemically or physically, may also be used.

Figure 4:
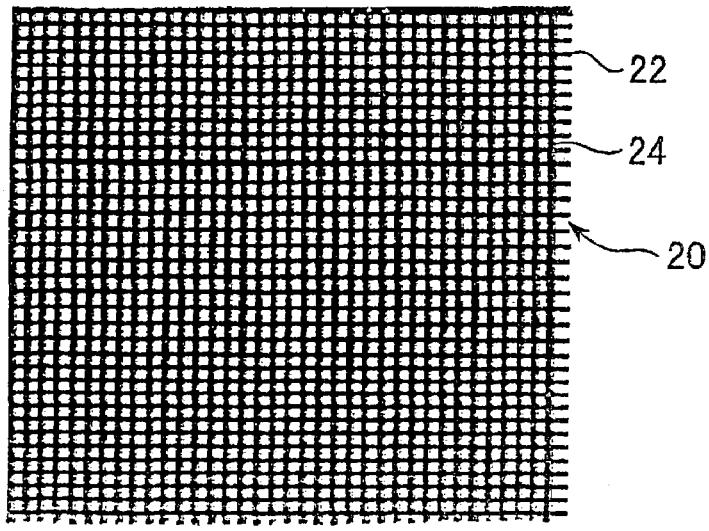
FIG. 4 is a plan view of a base material of the doctor blade of the invention before the fibrous layers are laminated.
Figure 7:
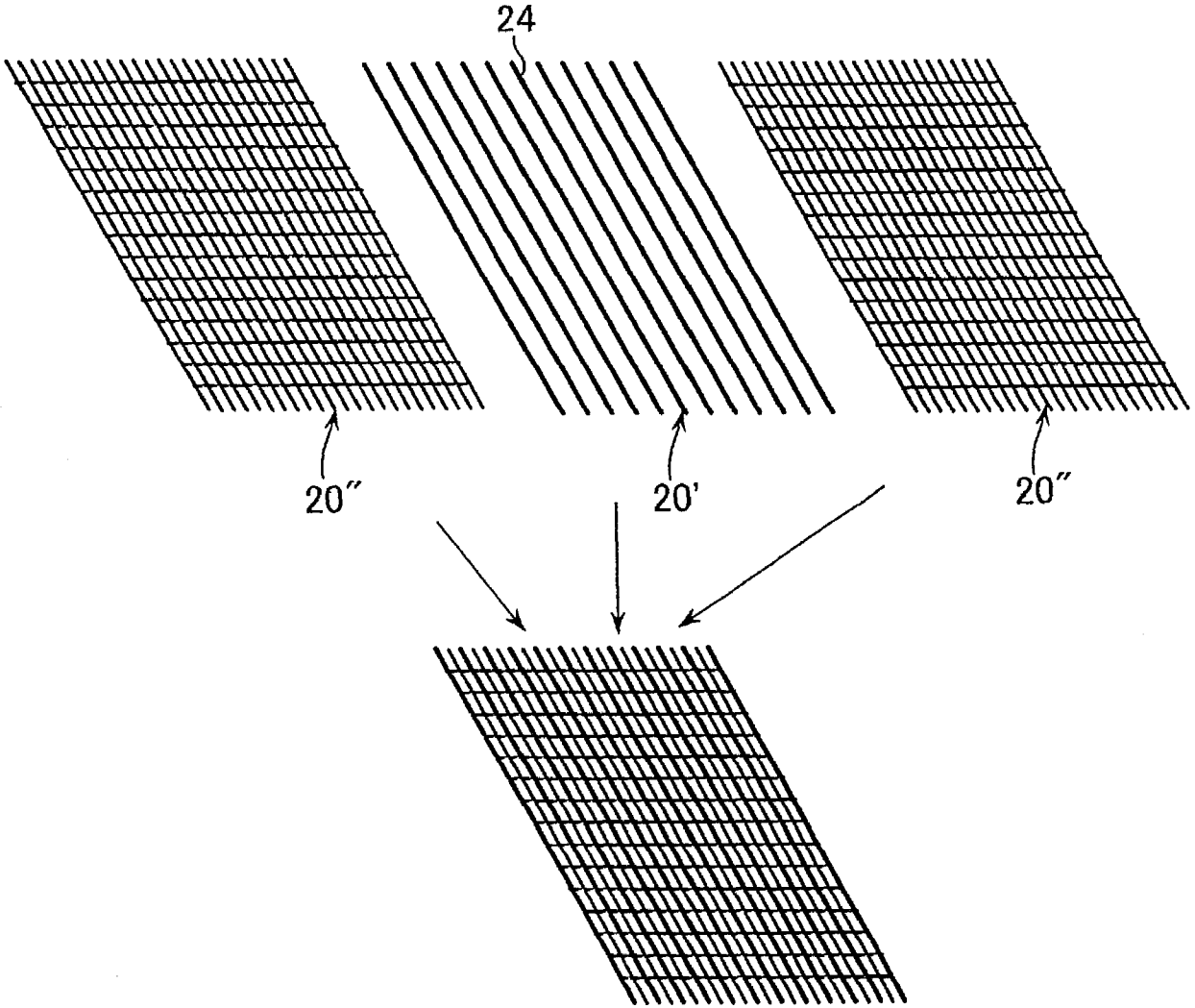
FIG. 7 is a perspective view showing different base materials to be combined, wherein one of the base materials is composed only of warp yarns, and also showing the combined base materials.
Figure 8:
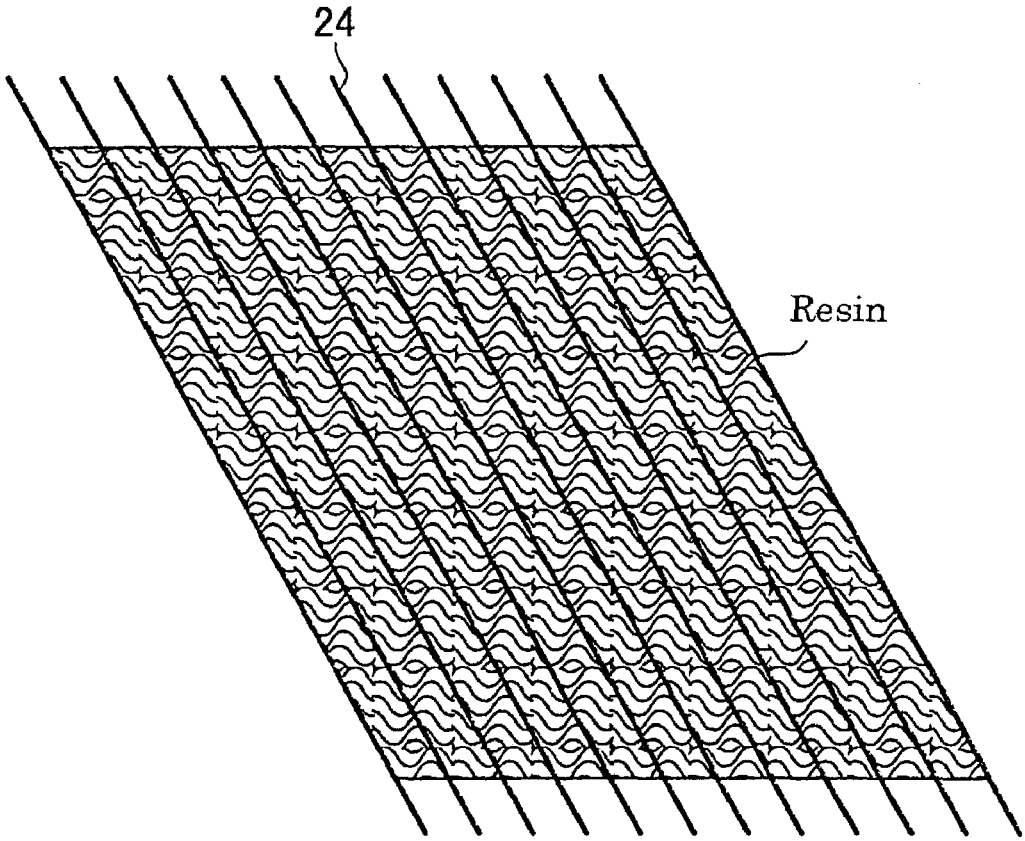
FIG. 8 is a perspective view of a base material composed only of warp yarns integrally bonded with resin.

A base material composed only of a warp 24 (FIG. 4) without a weft 22 may be used for the base material 20. In this case, since a base material composed only of warp 24 can become displaced during needling, the base material 20' composed only of a warp 24 may be sandwiched by other base materials 20" as shown in FIG. 7. The layers of base materials 20" may have either the same structure or different structures. Alternatively, to prevent the warp yarns 24 from becoming displaced, the warp yarns 24 can be integrally bonded with resin in the gaps between them, as shown in FIG. 8.

In addition, when a plurality of base material layers 20 are used in a laminate 50, they may be used along with films, spun bond, and resin-molded articles, and the like. When at least fibers in the layer which is in contact with a mating member are oriented, by carding or the like, in the direction of travel of the mating member, adhesion to the mating member improves, and a large number of fibers in the fibrous layer enter the grooves of the mating member and remove water efficiently.

Figure 1A:
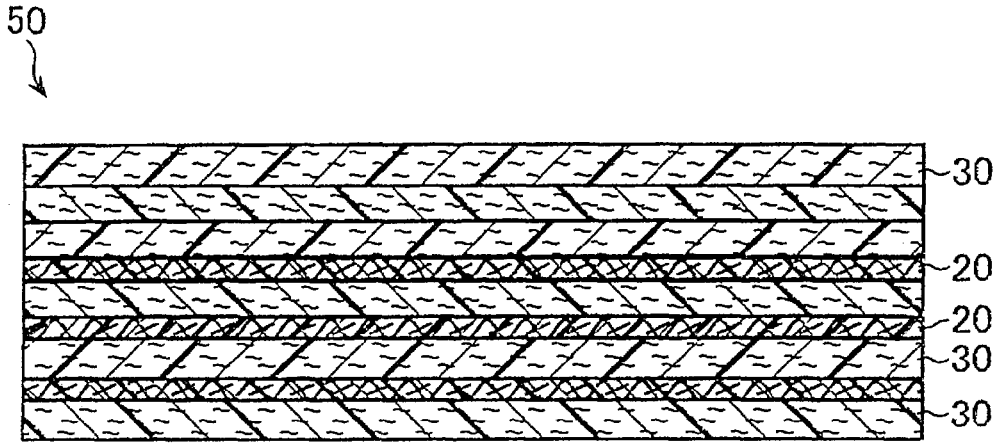
FIG. 1(*a*) is a cross-sectional view of a laminate forming a doctor blade for removing water according to the invention.
Figure 1B:
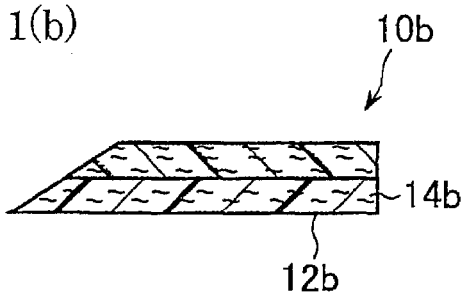
Figure 1C:
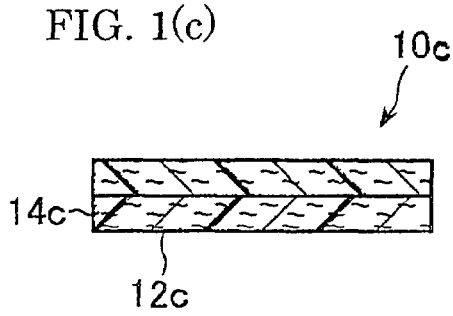
Figure 1D:
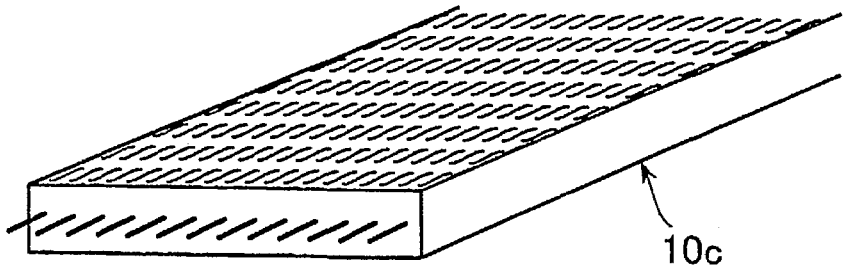
Figure 1E:
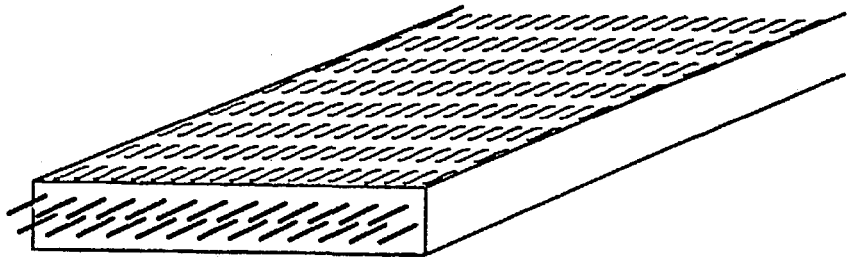
Figure 1F:
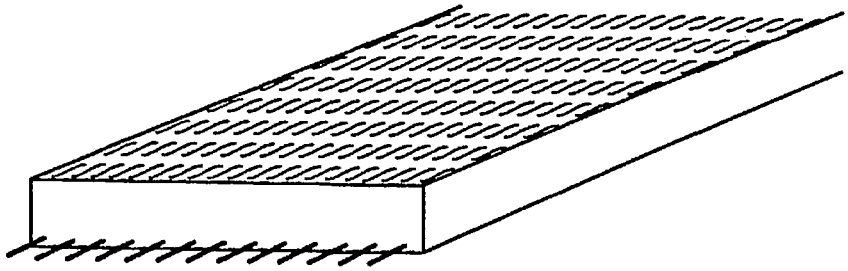
Figure 1G:
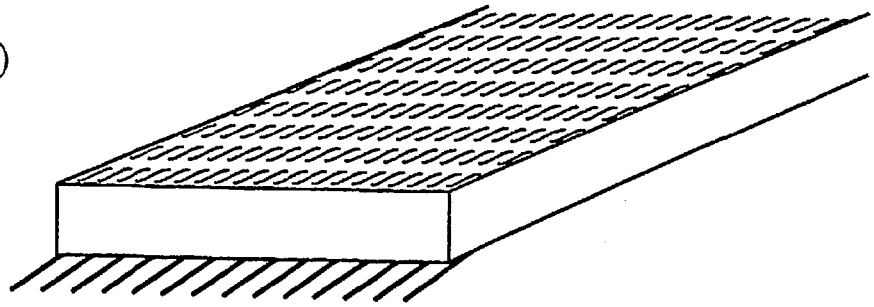
Figure 1H:
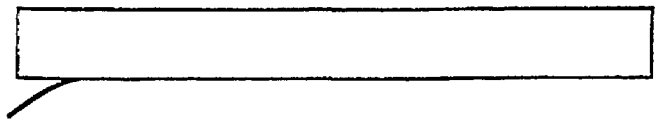
Figure 2A:
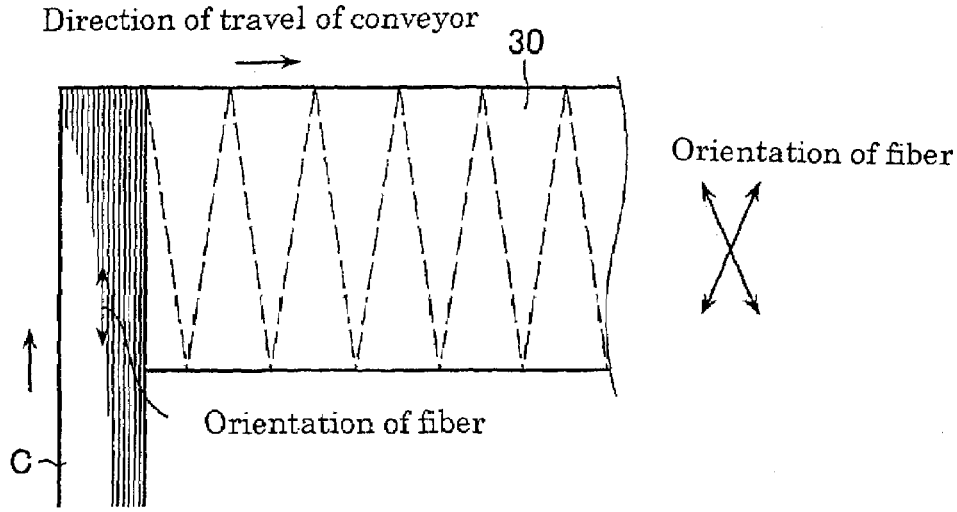
FIG. 2(*a*) is top plan view showing the use of a cross lapper wherein, after a web is opened by carding, it is laminated on a conveyer and a fibrous laminate is formed.
Figure 2B:
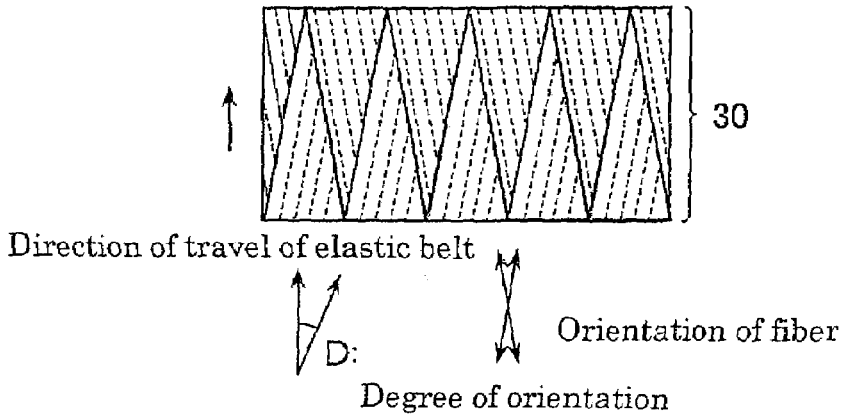

A fibrous layer 30 may be formed by laminating a web which is oriented in one direction by carding. Another method is to laminate webs C, which are oriented in one direction by carding, alternately at an angle by a cross lapper as shown in FIGS. 2(*a*) and 2(*b*). Preferably, the orientation D of the fibers in this case is within 15 degrees relative to the direction of travel of the mating member. In addition, at least a layer which is in contact with a mating member is a fibrous layer wherein the fibers are oriented in the direction of travel of the mating member for improving the tendency of these fibers to adhere to the mating member. Fibrous layers having a random orientation, or fibrous layers having an orientation which is not limited to the direction of travel of the mating member, or combinations of such layers, may be used for other layers.

The laminate 50, can be made up of a plurality of base material layers 20 and a plurality of fibrous layers 30, laminated and intertwiningly integrated by needle punching all together. Alternatively, the laminate 50 can be made up of units, each consisting of one or more base material layers 20 and one or more fibrous layers 30 intertwiningly integrated by needle punching, and thereafter laminating and intertwiningly integrating these units by needle punching. Although a general-purpose fiber such as polyamide fiber and polyester fiber and the like may be used for base material layers 20 and the fibrous layers 30, it is desirable to use an aromatic polyamide fiber or the like when heat resistance is required.

The base material layers 20 and the fibrous layers 30 may be glued together by resin or the like. However, the intertwining integration of these layers by needle punching has the advantage of suppressing the tendency of layers to peel off. A binder comprising a high-molecular weight compound may be added, by sprinkling, when heat meltable fibers are mixed into the fibrous layer 30 or when the fibrous layer is intertwiningly integrated with the base material by needling. Alternatively, the binder can be added, by sprinkling, after the layers are integrated, and heating may be carried out to make the fibers stick together before the laminate is impregnated with resin. The binder helps to prevent the loss of fibers from the doctor blade.

After the laminate 50 is impregnated with a resin solution, heating is carried out to cure the resin. The laminate is then cut, and, if necessary, a taper is formed by machining. Doctor blades 10*b* and 10*c*, having the shapes shown in cross-sectional views in FIGS. 1(*b*) and 1(*c*) for example, may be obtained. The resin solution, can be one in which a hardener, additive, and a thickener such as a methylcellulose etc., are mixed into a thermoplastic resin and/or thermosetting resin such as, for example, SBR (styrene butadiene co-polymer synthetic rubber), a polyurethane resin, acrylic resin, epoxy resin, or phenolic resin. The level of impregnation of resin into the laminate 50 may be controlled by increasing or decreasing the amount of the thickener mixed into the resin solution.

In doctor blades 10*b*, and 10*c*, shown in FIG. 1(*b*) and FIG. 1(*c*), the orientations of the fibers may differ from layer to layer. That is, although fibers of a fibrous 30 layer which comes into contact with a mating member are oriented in the direction of travel of the mating member, the fibers in the other fibrous layers, for example the layers having surfaces 12*b* and 12*c*, have a different orientation. The fiber in the fibrous layers 30 are prevented from falling off due to the intertwinement of the fiber which occurs when the layers are integrated by needling. Alternatively, fibrous layers wherein fibers are oriented in the direction of travel of a mating member may be used for all the layers of a doctor blade.

In these doctor blades 10*b* and 10*c*, the layers in which fibers are oriented in the direction of travel of an elastic belt under the surfaces 12*b* and 12*c* are referred to as mating member contacting layers 14*b* and 14*c*. In the case of the tapered doctor blade the upper and lower sides of the blade shown in FIG. 1(*b*) may be reversed. In this case, the part which is recessed as a result of tapering becomes a mating member contacting layer.

In selecting a resin abrasion resistance and hydrolysis resistance, etc. are considered. A single kind of resin, or a mixture consisting of several kinds of resin may be used.

The resin may be impregnated into the laminate by introducing fine particles of resin into the surface of the laminate 50, and then heating and pressurizing the laminate in a press.

The void content of the doctor blade 10 may be adjusted by controlling the density of the laminate 50 or the amount of impregnated resin. The void content can also be adjusted by adding a foaming agent to the resin solution or to the fine resin particles.

When a doctor blade is made by including an additive which has lubricity, such as a molybdenum disulfide, in the resin solution or fine resin particles, the frictional drag against an elastic belt can be decreased.

When the fibers forming the layers 14*b* and 14*c*, which come into contact with the elastic belt, are thick as compared with the fibers forming the layers which are not in contact with the elastic belt, a good water removal effect can be obtained due to the high rigidity of the fibers. However, when all the fibers in the layer which is in contact with the elastic belt are thick, the surface properties of the doctor blade are worse, the adhesion of the blade to the elastic belt is decreased. Superior surface properties and superior adhesion may be obtained by mixing thin fibers into the thick fibers.

Figure 3A:
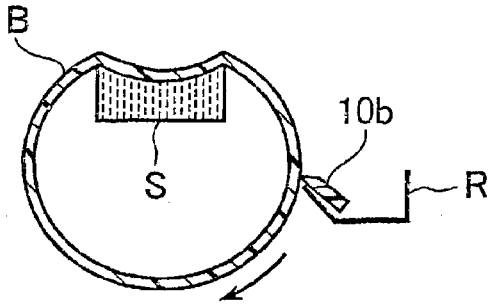
FIG. 3(*a*) is a schematic view showing a doctor blade in a shoe press, where only the tip of a doctor blade is in pressing contact with an elastic belt.
Figure 3B:
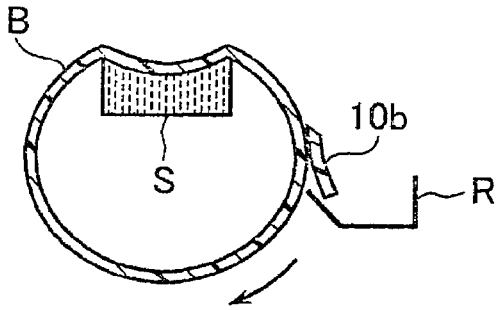

FIGS. 3(*a*) and 3(*b*) shows a doctor blade 10*b*, as shown in FIG. 1(*b*), used in a shoe press apparatus (the press roller is not shown). The water which is removed by the doctor blade 10*b* flows into a water receiver R. This doctor blade 10*b* may be used either with only its tip in pressing contact with a mating member B, as shown in FIG. 3(*a*), or in a deformed condition where a part of one of its faces is in pressing contact with the elastic belt B, as shown in FIG. 3(*b*). In either case, a mating member contacting layer 14*b* is in contact with the elastic belt B. When the doctor blade 10*b* is deformed, and used as shown in FIG. 3(*b*), a broader area of the doctor blade 10*b* is in contact with the mating member B.

Figure 5:
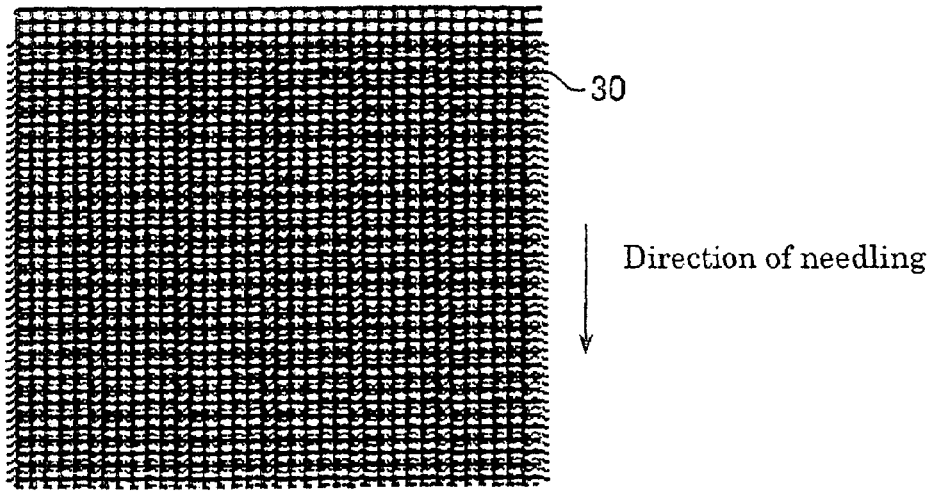
FIG. 5 is a plan view of the base material after the fibrous layers are laminated except for one part of the base material.
Figure 6:
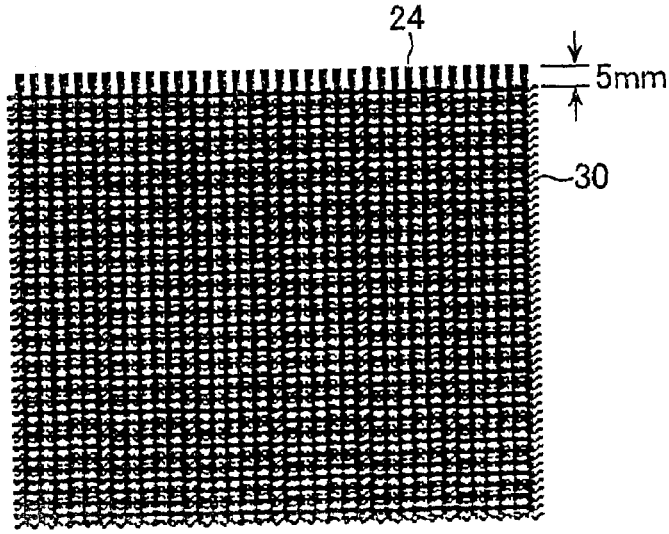
FIG. 6 is a plan view of the base material after the weft is removed from the part of the base material where the fibrous layers are not laminated, and warp of that part is cut evenly so that it is brush-shaped.

Referring to FIG. 10, in Example 1, a woven fabric of plain weave, having a basis weight of 100 g/m$^2$, which used a polyester monofilament (550 dtex) as a warp and polyester spun yarn (yarn count 10) as a weft, was used for a base material, and a polyester fiber (17 dtex) was used for a fibrous batt layer. No fibrous layer 30 was provided on one part of a base material 20 shown in FIG. 4, and consequently no fibrous layer 30 was laminated to that part of the base material 20 during needling. Needling was conducted as shown in FIG. 5, and fibrous layers 30 were provided on both sides of the base material 20. The amount of the polyester fiber in each layer was 120 g/m$^2$. Three such integrated units were piled up and integrated by needling so that the parts where the fibrous layer 30 was not laminated were identical. The polyester fiber (120 g/m$^2$) was laminated while integrated by needling, and a laminate having an areal weight (Metsuke) of 3500 g/m$^2$, and a thickness 10 mm as a whole, was obtained. Thereafter, the weft 22 was removed from the part where the fibrous layer 30 was not laminated to the base material, and the remaining warp 24 was cut evenly to a length of 5 mm. Thus, the warp 24 was made brush-shaped before use. In the following Examples, the same method of obtaining a brush-shaped warp was used. In each case, the density of the laminate as a whole was 0.35 g/cm$^3$.

In Example 2, a woven fabric of plain weave, having a basis weight 140 g/m$^2$, which used a polyester monofilament (110 dtex) as a warp and polyester spun yarn (yarn count 10) as a weft, was used for a base material. A polyester fiber (17 dtex) was used in the fibrous (batt) layers. The polyester fibrous layers were integrated with the base material by needling, and fibrous layers were provided on both sides of the base material. The amount of polyester fiber in each layer was 120 g/m$^2$. Three such integrated units were piled up and integrated by needling. Polyester fiber (120 g/m$^2$) was laminated while being integrated by needling, and a laminate having an areal weight (Metsuke) of 3500 g/m$^2$, and a thickness 10 mm as a whole was obtained. The density of this laminate was 0.35 g/cm$^3$.

In Example 3, a woven fabric of plain weave, having a basis weight of 140 g/m$^2$, which used a polyester multifilament (4.4 dtex, 250 strings) as a warp and polyester spun yarn (yarn count 10) as a weft, was used for a base material.

A polyester fiber (17 dtex) was used in the fibrous (batt) layers. The polyester fibrous layers were integrated with the base material by needling, and fibrous layers were provided on both sides of the base material. The amount of polyester fiber in each layer was 120 g/m$^2$. Three such integrated units were piled up and integrated by needling. Polyester fiber (120 g/m$^2$) was laminated while being integrated by needling, and a laminate having an areal weight (Metsuke) of 3500 g/m$^2$, and a thickness 10 mm as a whole was obtained. The density of this laminate was 0.35 g/cm$^3$.

In Example 4, a woven fabric of plain weave, having a basis weight of 100 g/m$^2$, which used a nylon monofilament (550 dtex) as a warp and polyester spun yarn (yarn count 10) as a weft, was used for a base material. A polyester fiber (17 dtex) was used in the fibrous (batt) layers. The polyester fibrous layers were integrated with the base material by needling, and fibrous layers were provided on both sides of the base material. The amount of polyester fiber in each layer was 120 g/m$^2$. Three such integrated units were piled up and integrated by needling. Polyester fiber (120 g/m$^2$) was laminated while being integrated by needling, and a laminate having an areal weight (Metsuke) of 3500 g/m$^2$, and a thickness 10 mm as a whole was obtained. The density of this laminate was 0.35 g/cm$^3$.

In Example 5, a woven fabric of plain weave, having a basis weight of 130 g/m$^2$, which used a nylon multifilament (360 dtex, 3 strings twisted yarn) as a warp, and polyester spun yarn (yarn count 10) as a weft, was used for a base material. A polyester fiber (17 dtex) was used in the fibrous (batt) layers. The polyester fibrous layers were integrated with the base material by needling, and fibrous layers were provided on both sides of the base material. The amount of polyester fiber in each layer was 120 g/m$^2$. Three such integrated units were piled up and integrated by needling. Polyester fiber (120 g/m$^2$) was laminated while being integrated by needling, and a laminate having an areal weight (Metsuke) of 3500 g/m$^2$, and a thickness 10 mm as a whole was obtained. The density of this laminate was 0.35 g/cm$^3$.

In Comparative Example 1, a woven fabric of plain weave, having a basis weight of 100 g/m$^2$, which used a polyester spun yarn (yarn count 10) as warp and weft, was used for a base material. A polyester fiber (17 dtex) was used in the fibrous (batt) layers. The polyester fibrous layers were integrated with the base material by needling, and fibrous layers were provided on both sides of the base material. The amount of polyester fiber in each layer was 120 g/m$^2$. Three such integrated units were piled up and integrated by needling. Polyester fiber (120 g/m$^2$) was laminated while being integrated by needling, and a laminate having an areal weight (Metsuke) of 3500 g/m$^2$, and a thickness 10 mm as a whole was obtained. The density of this laminate was 0.35 g/cm$^3$.

In Comparative Example 2, a woven fabric of plain weave, having a basis weight of 130 g/m$^2$, which used a polyester spun yarn (yarn count 5) as warp, and polyester spun yarn (yarn count 10 ) as a weft, was used for a base material. A polyester fiber (17 dtex) was used in the fibrous (batt) layers. The polyester fibrous layers were integrated with the base material by needling, and fibrous layers were provided on both sides of the base material. The amount of polyester fiber in each layer was 120 g/m$^2$. Three such integrated units were piled up and integrated by needling. Polyester fiber (120 g/m$^2$) was laminated while being integrated by needling, and a laminate having an areal weight (Metsuke) of 3500 g/m$^2$, and a thickness 10 mm as a whole was obtained. The density of this laminate was 0.35 g/cm$^3$.

A resin solution was prepared by mixing a water-soluble polyurethane resin, water-soluble epoxy resin, and hardener, and diluting them with water. This resin solution was applied to the one side of each of the above described laminates. Thereafter, the resin was dried and cured, cutting was conducted, and taper machining was conducted to produce doctor blades as shown in FIG. 1(*b*).

In the doctor blades of Examples 1 and 2 according to the invention, a polyester monofilament was used as the warp in the base material layer. In Example 3, a polyester multifilament yarn was used as the warp in the base material layer. In Example 4, a nylon monofilament was used as the warp in the base material layer. In Example 5, a nylon multifilament yarn was used as the warp in the base material layer.

Figure 9:
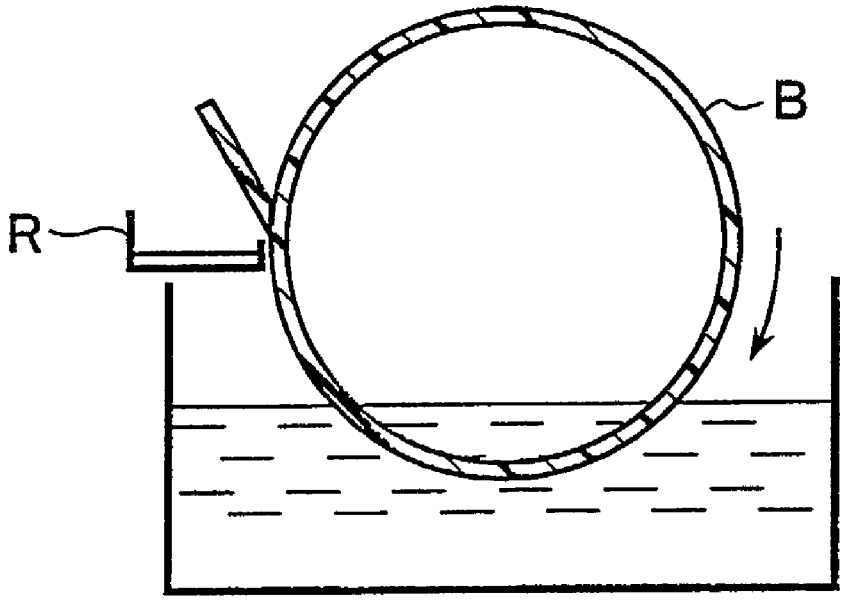
FIG. 9 is a schematic view of an apparatus for conducting a water removal capability test on doctor blades.
Figure 13:
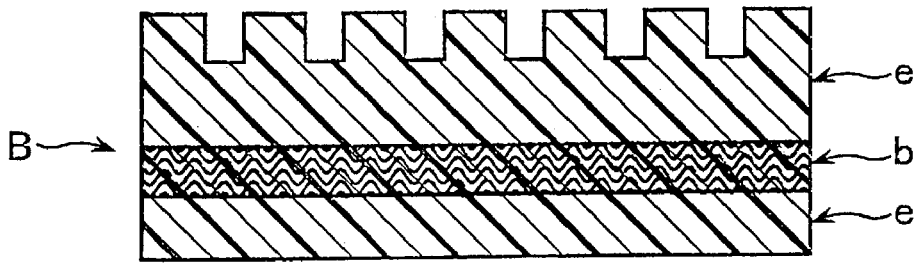
FIG. 13 PRIOR ART
FIG. 13 is enlarged cross-sectional view of an elastic belt used in a shoe press apparatus.

A water removal capability test was conducted on these doctor blades by using the apparatus shown in FIG. 13. In this apparatus, an endless elastic belt B was rotated in the direction of the arrow of FIG. 9, with part of the belt immersed and soaked in water. The doctor blade was held in contact with the belt, and the amount of removed water was measured. The belt B was an elastic belt made of polyurethane and having a plurality of grooves 1 mm in width, and 1 mm in depth, on its surface, with an interval of 3 mm between grooves.

After the belt B was rotated in the testing apparatus at 60 rpm for 100 hours, the amount of water removed by the doctor blade, that is, the amount of water accumulated in the water receiver R, was measured. The results of the water removing capability test are shown in FIG. 10. A large value in the water removal capability test results corresponds to a high water removal capability.

As shown in FIG. 10, it may be understood that the doctor blades of Examples 1–5 according to the invention exhibited excellent a water removal capability. On the other hand, Comparative examples 1, 2 were inferior in water removal capability.

Figure 11A:
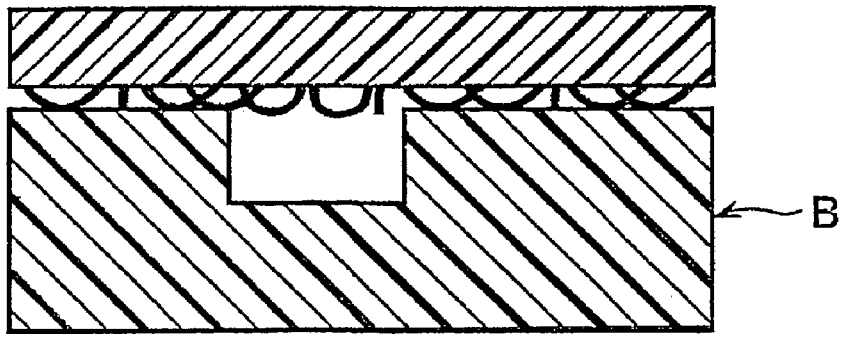
FIG. 11(*a*) is an explanatory cross-sectional view illustrating the extent to which the fibers of doctor blades of comparative examples enter the grooves of an elastic belt.
Figure 11B:
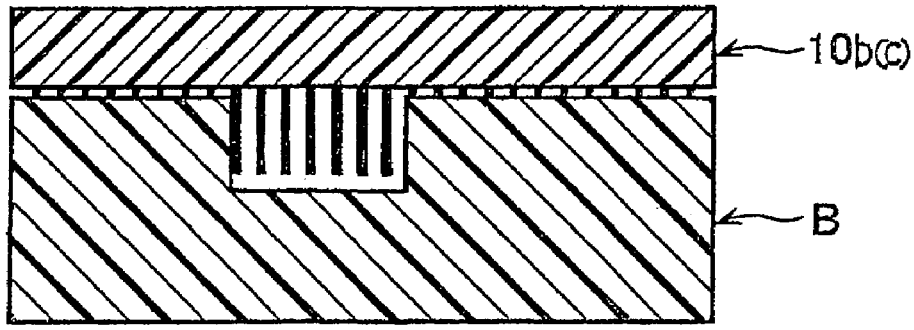
Figure 12:
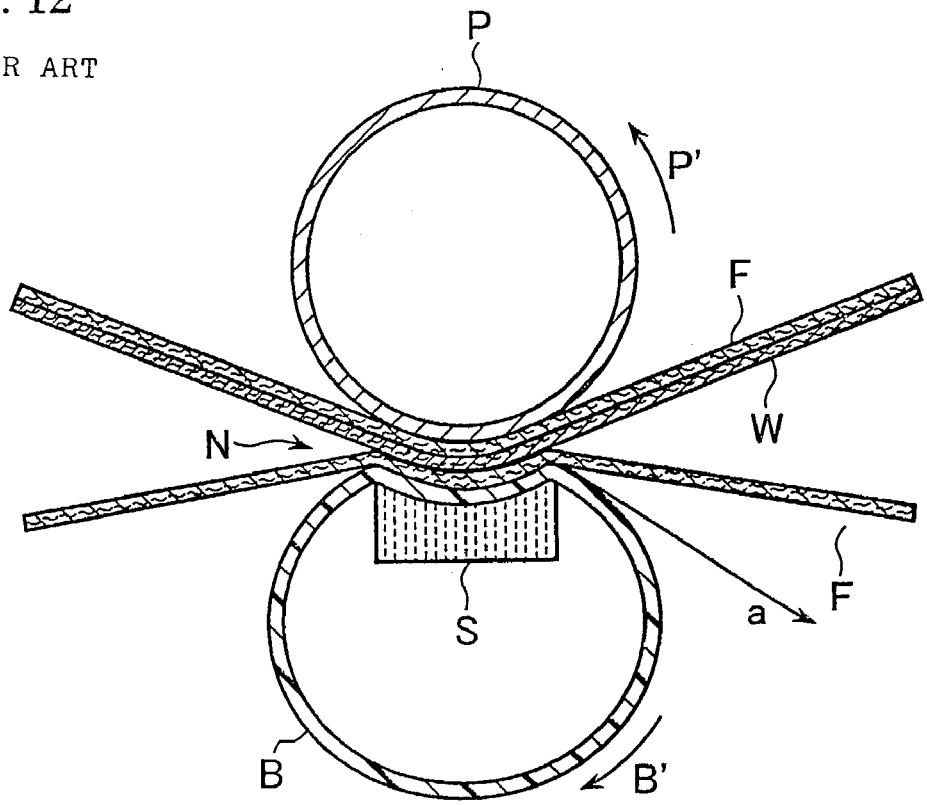
FIG. 12 PRIOR ART
FIG. 12 is a schematic view of a shoe press apparatus in the press part of a papermaking machine.

FIG. 11(*a*) illustrates the cooperation of the doctor blades of Comparative examples 1 and 2 with a grooved belt. FIG. 11(*b*) illustrates the cooperation of doctor blades according to the invention, having a brush-shaped warp, with a similar grooved belt. The doctor blade according to the invention exhibits improved water removal capability because the warp yarns of a layer in contact with a mating member are brush-shaped and enter the insides of the grooves.

Although the doctor blade according to the invention has been described as used with an elastic belt of a shoe press apparatus, the mating member from which water is removed is not necessarily limited to the elastic belt of a shoe press apparatus.

What is claimed is:

1. A doctor blade for removing water from a grooved mating member, the doctor blade comprising a fibrous laminate impregnated with resin, said fibrous laminate having an engagement surface for engagement with said mating member, said engagement surface having an interior side, and also having an exterior side, and said fibrous laminate comprising a base material having warp and weft yarns, wherein substantially all of the weft yarns of the doctor blade are confined to the interior side of said engagement surface of the laminate, and parts of at least some of the warp yarns of the base material protrude through said engagement surface to the exterior side thereof, forming an exposed brush-shaped structure, composed substantially entirely of warp yarns, adapted to enter, and remove water from, grooves of a mating member.

2. A doctor blade for removing water as claimed in claim 1, wherein the fibrous laminate comprises first and second layers, wherein said brush-shaped structure is composed of yarns of said first layer, and wherein the concentration of resin impregnated into said first layer is less than the concentration of resin impregnated into said second layer.

3. A doctor blade for removing water as claimed in claim 1, wherein said warp yarns which protrude through said engagement surface are monofilament yarns having a weight of 110 dtex or more, or multifilament yarns having a weight of 400 dtex or more.

4. A doctor blade for removing water as claimed in claim 3, wherein the fibrous laminate comprises first and second layers, wherein said brush-shaped structure is composed of yarns of said first layer, and wherein the concentration of resin impregnated into said first layer is less than the concentration of resin impregnated into said second layer.

* * * * *